US006819907B2

(12) United States Patent
Serizawa

(10) Patent No.: US 6,819,907 B2
(45) Date of Patent: Nov. 16, 2004

(54) IMAGE FORMING APPARATUS AND IMAGE FORMING METHOD

(75) Inventor: Yoji Serizawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/449,222

(22) Filed: May 30, 2003

(65) Prior Publication Data

US 2003/0235447 A1 Dec. 25, 2003

(30) Foreign Application Priority Data

May 30, 2002 (JP) ..... 2002-157323

(51) Int. Cl.[7] ..... G33G 15/00
(52) U.S. Cl. ..... 399/388; 399/77
(58) Field of Search ..... 399/388, 389, 399/394, 77, 38

(56) References Cited

U.S. PATENT DOCUMENTS

| | | | | | |
|---|---|---|---|---|---|
| 5,124,727 | A | * | 6/1992 | Yamazaki | 346/134 |
| 5,274,402 | A | | 12/1993 | Serizawa et al. | 346/160 |
| 5,321,486 | A | | 6/1994 | Nanbu et al. | 355/311 |
| 5,408,304 | A | | 4/1995 | Serizawa | 355/309 |
| 5,412,480 | A | | 5/1995 | Serizawa et al. | 358/296 |
| 5,512,929 | A | | 4/1996 | Serizawa et al. | 347/153 |
| 5,774,764 | A | | 6/1998 | Toyokura et al. | 399/77 |
| 5,940,653 | A | * | 8/1999 | Maekawa et al. | 399/9 |
| 6,021,284 | A | * | 2/2000 | Serizawa et al. | 399/8 |
| 6,169,567 | B1 | | 1/2001 | Hashimoto et al. | 347/262 |
| 6,204,872 | B1 | | 3/2001 | Hashimoto et al. | 347/153 |
| 6,312,173 | B1 | | 11/2001 | Hashimoto et al. | 400/70 |
| 6,347,203 | B1 | * | 2/2002 | Kutsuwada | 399/82 |
| 6,496,660 | B2 | | 12/2002 | Takahashi et al. | 399/16 |
| 2003/0077085 | A1 | | 4/2003 | Takahashi et al. | 399/16 |

* cited by examiner

*Primary Examiner*—Anthony H. Nguyen
(74) *Attorney, Agent, or Firm*—Fitzpatrick, Cella, Harper & Scinto

(57) ABSTRACT

An image forming apparatus on which a paper handling apparatus is detachably mountable is provided. The image forming apparatus includes an image processing section that processes an externally inputted image signal, an image forming section that forms an image on a paper sheet based on the image signal processed by the image processing section, and a control section that controls the image forming section based on an instruction from the image processing section, wherein the control section transmits to the image processing section a paper delivery signal indicating a timing to deliver paper sheets from the image forming section to the paper handling apparatus. The image processing section controls the paper handling apparatus based on the paper delivery signal received from the control section. The control section successively transfers a plurality of paper sheets at a first paper interval when images are successively formed on a plurality of paper sheets and the control section does not receive from the image processing section an instruction to transmit a paper delivery signal, and successively transfers a plurality of paper sheets at a second paper interval different from the first paper interval when images are successively formed on a plurality of paper sheets and the control section receives from the image processing section an instruction to transmit a paper delivery signal.

27 Claims, 12 Drawing Sheets

IMAGE FORMING APPARATUS AND IMAGE FORMING METHOD

BACKGROUND OF THE INVENTION

1. Field of the Invention

The present invention relates to image forming apparatuses and image forming methods.

2. Related Background Art

Conventionally, an image forming apparatus that uses the electronic photographing method may be equipped with, for example, a paper delivery apparatus that sorts out paper sheets on which images have been formed by the image forming apparatus into a plurality of jobs, and/or an optional paper delivery apparatus that performs optional processings such as stapling paper sheets. The paper delivery apparatus may be detachably mounted on the image forming apparatus, and may have a control structure shown in FIG. 12, for example.

The image forming apparatus shown in FIG. 12 includes a printer controller 101 that communicates with a host computer (not shown) and receives image data from the host computer, converts the received image data into data in a data format that is compatible with the image forming apparatus, and sends the data as an image signal (/VDO signal 116) to an engine controller 102.

The engine controller 102 controls various operations for forming images, and performs serial communication with the printer controller 101. In the serial communication, command/status signals (/SC signals) are exchanged in synchronism with a serial clock signal (/SCLK signal).

A paper delivery optional apparatus control section 117 controls transfer and discharge operations for recording media in the paper delivery apparatus based on commands received through serial signal lines 118 and 119 from the printer controller 101.

In the conventional image forming apparatus indicated in FIG. 12, without regard to whether or not the image forming apparatus is connected to an optional paper delivery apparatus, or without regard to whether or not a paper delivery destination is an optional paper delivery apparatus, multiple printing paper sheets are always fed at the same timing to maintain constant paper interval.

Under the circumstance, there are strong demands in image forming apparatuses that can properly control paper interval of multiple paper sheets depending on whether or not an image forming apparatus is connected to an optional paper delivery apparatus, or without regard to whether or not a paper delivery destination is an optional paper delivery apparatus

SUMMARY OF THE INVENTION

The present invention relates to improvements in image forming apparatuses.

The present invention relates to an image forming apparatus on which a paper delivery apparatus is detachably mounted, the image forming apparatus including an image processing section that processes an image signal inputted from an external apparatus, an image forming section that forms an image on a paper sheet based on the image signal processed by the image processing section, and a control section that controls the image forming section based on an instruction from the image processing section. The control section transmits to the image processing section a paper delivery signal indicating a timing to deliver paper sheets from the image forming section to the paper delivery apparatus. The image processing section controls the paper delivery apparatus based on the paper delivery signal received from the control section. The control section controls such that a plurality of paper sheets are successively transferred at a first paper interval when images are successively formed on a plurality of paper sheets and the control section does not receive from the image processing section an instruction to transmit a paper delivery signal. Also, the control section controls such that a plurality of paper sheets are successively transferred at a second paper interval different from the first paper interval when images are successively formed on a plurality of paper sheets, and the control section receives from the image processing section an instruction to transmit a paper delivery signal.

The present invention also relates to an image forming apparatus on which a paper delivery apparatus is detachably mounted, the image forming apparatus including an image processing section that processes an image signal inputted from an external apparatus, an image forming section that forms an image on a paper sheet based on the image signal processed by the image processing section, and a control section that controls the image forming section based on an instruction from the image processing section. The control section transmits to the image processing section a paper delivery signal indicating a timing to deliver paper sheets from the image forming section to the paper delivery apparatus. The image processing section controls the paper delivery apparatus based on the paper delivery signal received from the control section. The control section judges that the paper delivery apparatus is not connected to the image forming apparatus when it does not receive from the image processing section an instruction to transmit a paper delivery signal, and judges that the paper delivery apparatus is connected to the image forming apparatus when it receives from the image processing section an instruction to transmit a paper delivery signal.

The present invention relates to an image forming apparatus on which a paper delivery apparatus is detachably mounted, the image forming apparatus including an image forming section that forms an image on a paper sheet based on an image signal processed by an image processing section that processes an image signal inputted from an external apparatus, and a control section that controls the image forming section based on an instruction from the image processing section. The control section transmits to the image processing section a paper delivery signal indicating a timing to deliver paper from the image forming section to the paper delivery apparatus. The control section controls such that a plurality of paper sheets are successively transferred at a first paper interval when images are successively formed on a plurality of paper sheets and the control section does not receive from the image processing section an instruction to transmit a paper delivery signal. The control section also controls such that a plurality of paper sheets are successively transferred at a second paper interval different from the first paper interval when images are successively formed on a plurality of paper sheets and the control section receives from the image processing section an instruction to transmit a paper delivery signal.

The present invention also relates to an image forming method for an image forming apparatus on which a paper delivery apparatus is detachably mounted. The method may include: a transmission step of transmitting from a control section that controls the image forming section to the image processing section a paper delivery signal indicating a timing to deliver paper sheets from the image forming section to the paper delivery apparatus; a control step of controlling the paper delivery apparatus by the image processing section based on the paper delivery signal transmitted in the transmission step; and a transfer step of successively transferring a plurality of paper sheets. The transfer step includes successively transferring a plurality of paper sheets at a first paper interval when the control section receives from the image processing section an instruction to transmit a paper delivery signal, and successively lo transferring a plurality of paper sheets at a second paper interval different from the first paper interval when the control section does not receive from the image processing section an instruction to transmit a paper delivery signal.

Furthermore, the present invention relates to an image forming apparatus on which a paper delivery apparatus is detachably mounted, the image forming apparatus including: an image processing section that processes an image signal inputted from an external apparatus; an image forming section that forms an image on a paper sheet based on the image signal processed by the image processing section; a paper standby section that place in a standby condition paper sheets that are fed by the image forming section to be delivered at a first paper interval for forming images thereon; and a control section that controls the image forming section and the paper sheet standby section based on an instruction from the image processing section. The control section transmits to the image processing section a paper delivery signal indicating a timing to deliver paper sheets from the image forming section to the paper delivery apparatus. The image processing section controls the paper delivery apparatus based on the paper delivery signal received from the control section, wherein the control section controls the paper standby section such that a plurality of paper sheets are successively transferred at a first paper interval when images are successively formed on the plurality of paper sheets and the control section does not receive from the image processing section an instruction to transmit a paper delivery signal, and controls the paper standby section such that a plurality of paper sheets are successively transferred at a second paper interval different from the first paper interval when images are successively formed on a plurality of paper sheets and the control section receives from the image processing section an instruction to transmit a paper delivery signal.

Other objects, features and advantages of the invention will become apparent from the following detailed description taken in conjunction with the accompanying drawings.

DESCRIPTION OF THE PREFERRED EMBODIMENTS

First Embodiment

Figure 1:
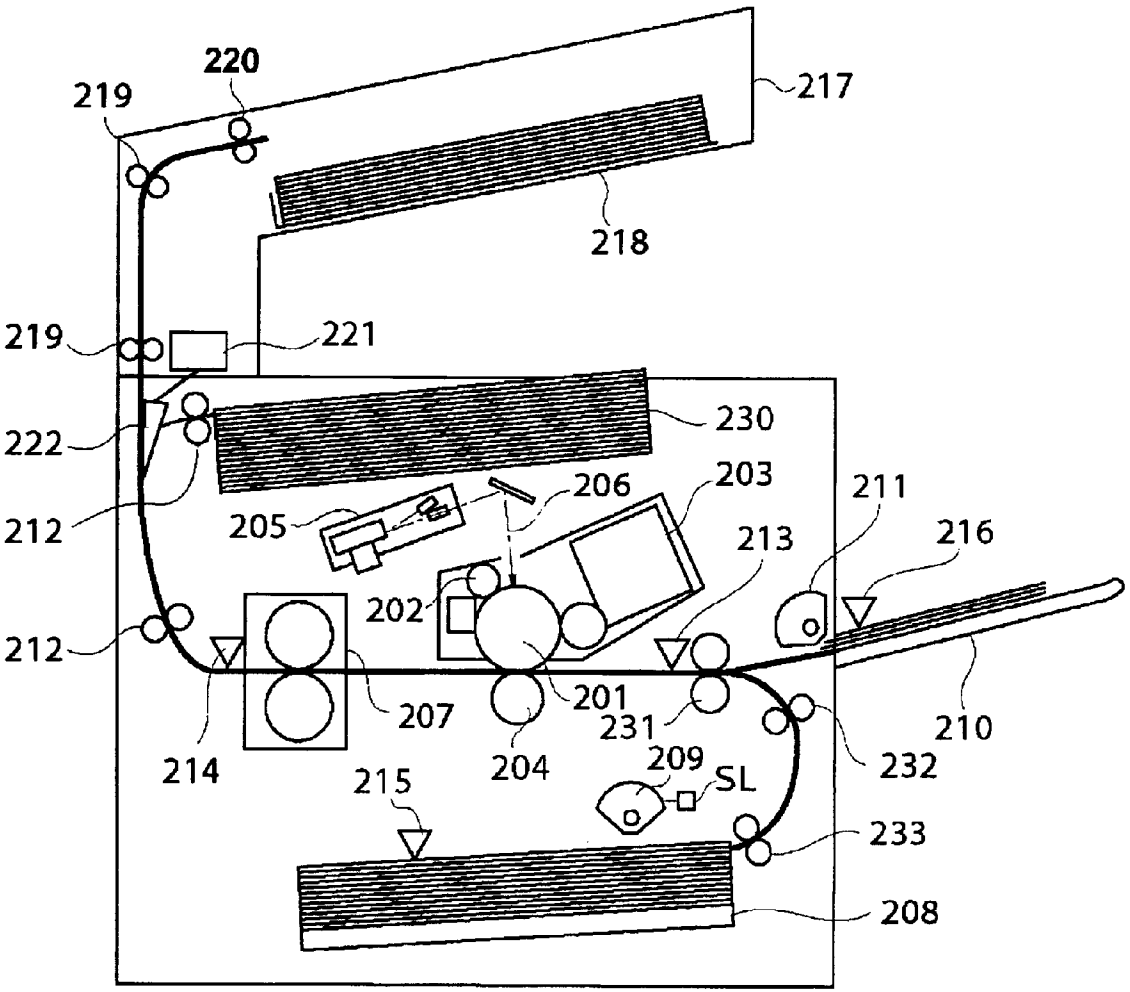
FIG. 1 shows a cross-sectional view of a structure of an electronic photography type printer.

FIG. 1 schematically shows a cross-sectional view of an electronic photography type printer.

As shown in FIG. 1, the electronic photography type printer includes a photosensitive drum 201 that forms thereon electrostatic latent images, a charge roller 202 that uniformly charges the photosensitive drum 201, and an optical unit 205 that scans a laser beam on the photosensitive drum 201. The optical unit 205 emits a laser beam 206. A developer 203 develops with toner electrostatic latent images on the photosensitive drum 201 formed by the laser beam 206. A transfer roller 204 transfers toner images on the photosensitive drum 204 onto a predetermined paper medium. A fixer 207 melts the toner on the paper medium to fix the toner on the paper sheet.

The printer of the present embodiment is also equipped with a standard cassette 208 that stores a stack of paper sheets (recording paper sheets) for printing, standard cassette paper feeding rollers 209 that pick up paper sheets one by one from the standard cassette 208, a solenoid SL that is switched on and off to control contact/non-contact states of the standard cassette paper feeding rollers 209, a manual feeding tray 210, manual feeding rollers 211, and delivery rollers 212 that delivers paper sheets outside the printer. A register sensor 213 detects a leading edge of each paper sheet for synchronizing the paper sheet and a toner image on the photosensitive drum 201. A delivery sensor 214 is provided to confirm whether or not each paper sheet normally passes the fixer 207. A sensor 215 is provided to detect the presence/absence of paper sheets in the standard cassette 208. A sensor 216 is provided to detect the presence/absence of paper sheets that are manually fed. Register rollers lo 231 synchronize each paper sheet and toner images on the photosensitive drum 201. Transfer rollers 232 and 233 are provided along the paper feed path. The components described above compose a printer engine that is an image forming section of the printer.

In the illustrated embodiment, the printer is connected to a paper delivery stacker 217, which is an optional paper delivery apparatus that can be detachably mounted on the printer. The paper delivery stacker 217 includes a paper delivery tray 218, paper delivery rollers 219 that transfer paper sheets inside the paper delivery stacker 217, delivery rollers 220 having a job offset function, and a solenoid 221 for a paper delivery flapper 222. Roller shafts of the delivery rollers 220 may be shifted in a vertical direction during paper feeding to thereby group a print job composed of a plurality of paper sheets into individual jobs. The solenoid 221 switches the paper delivery flapper 222 such that paper sheets are either delivered to a paper delivery tray 230 within the printer main body, or to the paper delivery tray 218 of the paper delivery stacker 217. The solenoid 221 is controlled by a paper delivery stacker control section 317 that controls the paper delivery stacker 217.

When a delivery destination for a paper sheet is switched by the paper delivery flapper 222, the solenoid 221 is controlled before a leading edge of the paper sheet reaches the paper delivery flapper 222 such that the paper sheet is delivered to the paper delivery destination.

More specifically, in order to switch the delivery destination of a paper sheet to the paper delivery tray 230 of the printer or to the paper delivery tray 218 of the paper delivery stacker 217, the energization state of the solenoid 221 is turned on and off. Since the switching operation needs a predetermined switching time, the timing to switch the energization state of the solenoid 221 is set to a timing which is a predetermined switching time before the leading edge of the paper sheet reaches the paper delivery flapper 222, in order to secure time margin for the response time of the solenoid 221. After the paper delivery destination is switched, the on/off state of the solenoid 221 is fixed until the trailing edge of the paper sheet completely passes the paper delivery flapper 222. If the paper delivery flapper 222 is driven before the paper sheet completely passes the paper delivery flapper 222, there is a danger that the toner image on the paper sheet may be destroyed by the paper delivery flapper 222.

Figure 2:
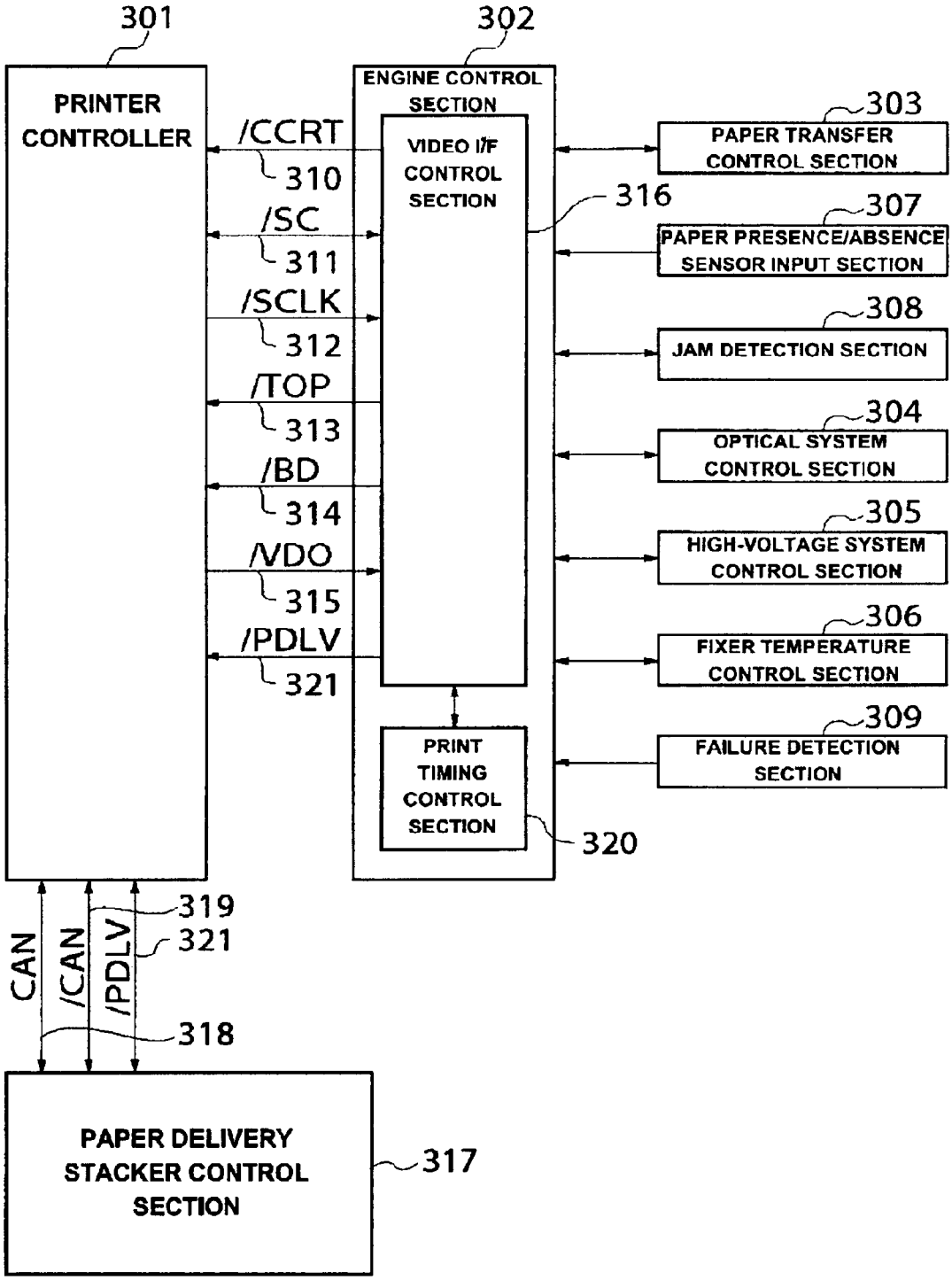
FIG. 2 shows a block diagram of a control structure of an electronic photography type printer.

FIG. 2 shows a block diagram of a control structure of the electronic photographic type printer shown in FIG. 1.

The control structure shown in FIG. 2 includes a printer controller 301, which communicates with an external apparatus such as a host computer (not shown) and receives image data (image signal), converts the image data into data in a data format that is compatible with the printer and supplies the data to an engine control section 302, and exchanges a variety of signals through serial communications with the engine control section 302.

The engine control section 302 controls each unit of the printer engine through serial communications under the control of the printer controller 301. A paper transfer control section 303 controls feeding and transfer of paper sheets based on instructions from the engine control section 102. It is noted that, in the following description, paper sheets within the printer main body are assumed to be always transferred at a constant speed.

The printer engine means an image forming section that forms images on paper sheets in the electronic photographic type printer, and forms images on paper sheets based on image data that is transmitted from the printer controller 301.

An optical system control section 304 executes driving of a scanner motor and ON/OFF controls of the laser beam based on instructions from the engine control section 302. A high-voltage system control section 305 executes high voltage outputs that are required for electronic photographing processings such as charging, developing and image transfer according to instructions from the engine control section 302. A fixer temperature control section 306 performs temperature control and abnormality detection for the fixer 207 according to instructions from the engine control section 302.

A paper presence/absence sensor input section 307 transmits detection signals generated by paper presence/absence sensors provided at the paper feeding section and along the paper transfer path to the engine control section 302. A jam detection section 308 detects transfer failure of paper sheets during their transfer. A failure detection section 309 detects failures in the functions within the printer.

A video interface control section 316 is provided inside the engine control section 302, and judges commands transmitted through serial communications from the printer controller 301, returns status signals, and sets the internal condition of the engine to a mode that is designated by the printer controller 301.

A print timing control section 320 is provided within the engine control section 302. The print timing control section 320 receives connection presence/absence information about the paper delivery optional apparatus which is outputted from the printer controller 301 through the video interface control section 316, and performs paper feed timing control based on the connection presence/absence information to thereby appropriately control the paper interval to improve the efficiency in the image forming processing.

The printer controller 301 and the engine control section 302 send and receive signals 310–321 indicated in FIG. 2. The signal 310 is a condition change signal (/CCRT signal) with which the engine control section 302 notifies the printer controller 301 of a change in the internal condition of the engine. The signal 311 is a command/status signal (/SC signal) in serial communications, which may be a command signal outputted from the printer controller 301 to the engine control section 302, or a status signal outputted from the engine control section 302 to the printer controller 301.

The signal 312 is a serial clock signal (/SCLK signal) for transmitting the command signal and the status signal in synchronism with the clock signal. The signal 313 is a /TOP signal, which is outputted from the engine control section 302 to the printer controller 301, for synchronizing the leading edge of a paper sheet and the leading edge of a toner image on the photosensitive drum 201 (for vertical synchronization). The signal 314 is a horizontal synchronizing signal (/BD signal) that is outputted in synchronism with the laser beam 206 which is scanned on each face of a rotary multi-face mirror. The signal 315 is an image signal (/VDO signal) that is outputted from the printer controller 301 to the engine control section 302. The signal 321 is a /PDLV signal that is outputted from the engine control section 302 to the printer controller 301 in response to a command from the printer controller 301, which functions as a signal indicating a timing to deliver paper from the engine main body.

A paper delivery stacker control section (paper delivery optional control section) 317 controls transfer and delivery of paper by the optional paper delivery stacker 217, and also controls data exchanges through serial communications with the printer controller 301. Differential signals CAN and /CAN 318 and 319 are used for serial communications between the printer controller 301 and a paper delivery optional apparatus (e.g., the paper delivery stacker 217).

In one example, each of the printer controller 301, the engine control section 302, and the paper delivery stacker control section 317 may be composed of a microcomputer that includes a CPU, ROM, RAM and the like.

The paper delivery stacker 217 in accordance with the present embodiment is controlled by the paper delivery stacker control section 317 based on signals that are transmitted through serial communications (CAN signals) from the printer controller 301, and there is no exchange of signals through serial communications between the engine control section 302 and the paper delivery stacker control section 317. In other words, the paper delivery stacker 217 is not controlled by the engine control section 302, but is controlled by the printer controller 301.

The paper delivery stacker 217, which is controlled by the printer controller 301, needs to know at least timings at which the printer delivers paper sheets to the paper delivery stacker 217. For example, preparations need to be made for switching the paper delivery destination by the solenoid 221 from the printer to the paper delivery stacker 217, and for delivering paper sheets, which are transferred from the printer, in the paper delivery stacker 217, which is executed by the paper delivery stacker control section 317.

For this purpose, in the embodiment example, a paper delivery signal (/PDLV signal) indicating a timing to deliver paper from the printer to the paper delivery stacker 217 is transmitted from the engine control section 302 to the printer controller 301 through a physical signal line, which is a /PDLV signal line 321. In this embodiment, for example, the engine control section 302 may transmit a paper delivery signal (/PDLV signal) to the printer controller 301, when the paper delivery apparatus sensor 214, which is disposed downstream in the transfer path of the fixer 207 in the printer, detects the trailing edge of a paper sheet.

Upon receiving the paper delivery signal (/PDLV signal) from the engine control section 302, the printer controller 301 transmits the paper delivery signal (/PDLV signal) received from the engine control section 302 to the paper delivery stacker control section 317 through the serial signal line (CAN) for controlling the paper delivery stacker control section 317.

When the paper delivery stacker 217 is connected to the printer, the printer controller 301 transmits to the engine control section 302 through the serial communications line (/SC) a command instructing that the /PDLV signal be transmitted. When the engine control section 302 does not receive a command instructing that the paper delivery signal (/PDLV signal) be transmitted, the engine control section 302 does not transmit the paper delivery signal (/PDLV signal) even when the paper delivery sensor 214 detects the trailing edge of a paper sheet. When the engine control section 302 receives a command instructing that the paper delivery signal (/PDLV signal) be transmitted, the engine control section 302 transmits the paper delivery signal (/PDLV signal) in response to a detection by the paper delivery sensor 214 of the trailing edge of a paper sheet.

In other words, the command instructing to transmit a paper delivery signal (/PDLV signal) is transmitted from the printer controller 301 to the engine control section 302 only when the paper delivery stacker 217 is connected to the printer. Accordingly, the engine control section 302 judges that the paper delivery stacker 217 is connected to the printer when it receives the instruction command from the printer controller 301, and judges that the paper delivery stacker 217 is not connected to the printer when it does not receive the instruction command from the printer controller 301.

It is possible that a new command for indicating that the paper delivery stacker 217 is connected to the printer may be provided such that the printer controller 301 can notifies the engine control section 302 of the fact that the paper delivery stacker 217 is connected to the printer. Such new command complicates the command structure In accordance with the present embodiment example, determinations can be made, with existing commands and without complicating the command structure, as to whether or not the paper delivery stacker 217 is connected to the printer. As a result, processings performed by the printer system would not become complicated.

Figure 3:
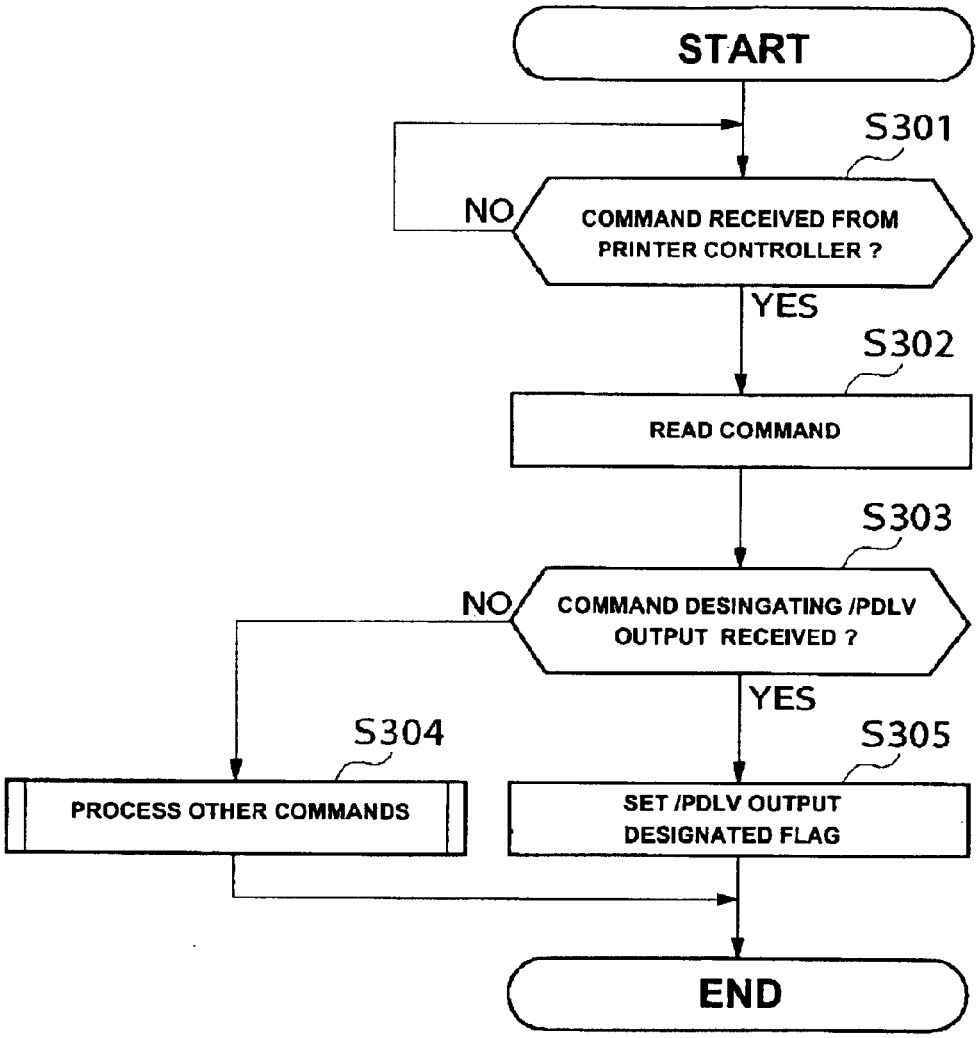
FIG. 3 shows a flow chart of a process to determine whether or not a paper delivery stacker is connected to a printer.

With the structure described above, the engine control section 302 judges as to whether or not the paper delivery stacker 217 is connected to the printer according to processings indicated in FIG. 3.

FIG. 3 shows a flow chart of processings for judging as to whether or not the paper delivery stacker 217 is connected to the printer.

After the printer is powered on, the printer control 301 judges through the serial signal lines (/CAN, CAN) as to whether the printer is connected to the paper delivery stacker 217.

Then, the printer controller 301 may receive an image signal for a plurality of pages to be printed from an external apparatus such as a host computer, and a signal indicating a delivery destination of each of the plurality of pages of the image signal.

If the signal indicating a delivery destination of each of the plurality of pages of the image signal to be printed includes a designation of the paper delivery tray 218 of the paper delivery stacker 217 as a paper delivery destination, the printer controller 301 transmits to the engine control section 302 a command instructing that the paper delivery signal (/PDLV signal) be transmitted.

In other words, the printer controller 301 transmits to the engine control section 302 a command instructing that the paper delivery signal (/PDLV signal) be transmitted, when a determination is made that the printer is connected to the paper delivery stacker 217, and the delivery destination of paper (e.g., a single page or plural pages) is the paper delivery tray 218 of the paper delivery stacker 217.

Then, in step S301, the engine control section 302 judges as to whether or not it received a command from the printer controller 301 through the command/status signal line. When it is judged that the command is received, the engine control section 302 proceeds to step S302.

In step S302, the engine control section 302 analyzes the command received from the printer controller 301.

In step S303, the engine control section 302 judges as to whether or not the command analyzed by the engine control section 302 in step S302 is a command instructing that the paper delivery signal (/PDLV signal) be transmitted. When-the command is judged to be the command instructing that the paper delivery signal (/PDLV signal) be transmitted, the engine control section 302 proceeds to step S305, and when it is judged not to be the command instructing that the paper delivery signal (/PDLV signal) be transmitted, the engine control section 302 proceeds to step S304.

In step S304, the engine control section 302 executes a process according to the command received from the printer controller 301 (for example, starting a print operation).

In the meantime, in step S305, as the paper delivery stacker 217, which is a paper delivery apparatus, is determined to be connected to the printer, a flag is set to indicate that the instruction that the paper delivery signal be transmitted (/PDLV signal output designated) is given.

As described above, the command instructing that the paper delivery signal (/PDLV signal) be transmitted is transmitted from the printer controller 301 to the engine control section 302 only when the paper delivery stacker 217 is connected to the printer. Accordingly, the engine control section 302 judges that the paper delivery stacker 217 is connected to the printer when the instruction that the paper delivery signal be transmitted (/PDLV output designated) is given in step S305.

The above describes the processings to judge as to whether or not the paper delivery stacker is connected to the printer.

In view of the above, by analyzing the existing command, a judgment can be made as to whether or not the printer is connected to the paper delivery stacker 217, without adding a new kind of command to be transmitted from the printer controller 301 to the engine control section 302.

The capability of the engine control section 302 to judge as to whether the paper delivery stacker 217 is connected to the printer creates new possibilities as follows.

In general, image forming apparatuses such as printers are desired to form images on paper sheets and output the same as many as possible within a predetermined time period, and therefore it is desired that an interval between a trailing edge of a preceding paper sheet and a leading edge of a succeeding paper (hereafter referred to as a "paper interval) on which images are successively formed be made as short as possible. Also, paper may be delivered from an image forming apparatus to any one of plural different types of optional paper delivery apparatuses that are possibly be connected to the image forming apparatus.

For this reason, the paper interval for paper to be delivered from the image forming apparatus to such optional paper delivery apparatuses is set such that any of the optional paper delivery apparatuses can divide paper delivered from the image forming apparatus and/or perform after-processings on the delivered paper.

For example, a flapper is used to switch the paper delivery destination between a paper delivery tray provided on the image forming apparatus and a paper delivery tray provided on a paper delivery apparatus which is an optional apparatus, and the flapper requires a certain amount of time for switching its direction. Therefore, a paper interval that can cope with the required switching time is set at the image forming apparatus. Also, for example, when paper sheets for a plurality of different print jobs are delivered to the same tray in a paper delivery apparatus, the paper delivery roller pair is shifted by a predetermined distance in a direction perpendicular to the paper transfer direction in order to provide an offset for each of the different print jobs, and the shifting of the paper delivery roller pair requires a certain amount of time. Therefore, a paper interval that can cope with the required shifting time is set at the image forming apparatus.

However, if the paper interval is set at the image forming apparatus in the manner described above, the number of paper sheets on which images are formed in a predetermined unit time period (hereafter referred to as the "throughput") may become fewer than the number of paper sheets the image forming apparatus can actually form images.

For example, when an optional paper delivery apparatus is not connected to the image forming apparatus, the paper interval at the image forming apparatus may be set shorter than a paper interval with which an optional paper delivery apparatus can normally operate. However, when such a paper interval is not set at the image forming apparatus, paper sheets cannot be delivered at the maximum throughput that can actually be achieved by the image forming apparatus by itself.

In view of the above, to achieve an optimum throughput depending on whether or not an image forming apparatus such as a printer is connected to an optional paper delivery apparatus, it is effective to switch the paper interval within the image forming apparatus depending on whether or not the image forming apparatus is connected to an optional paper delivery apparatus.

Figure 4:
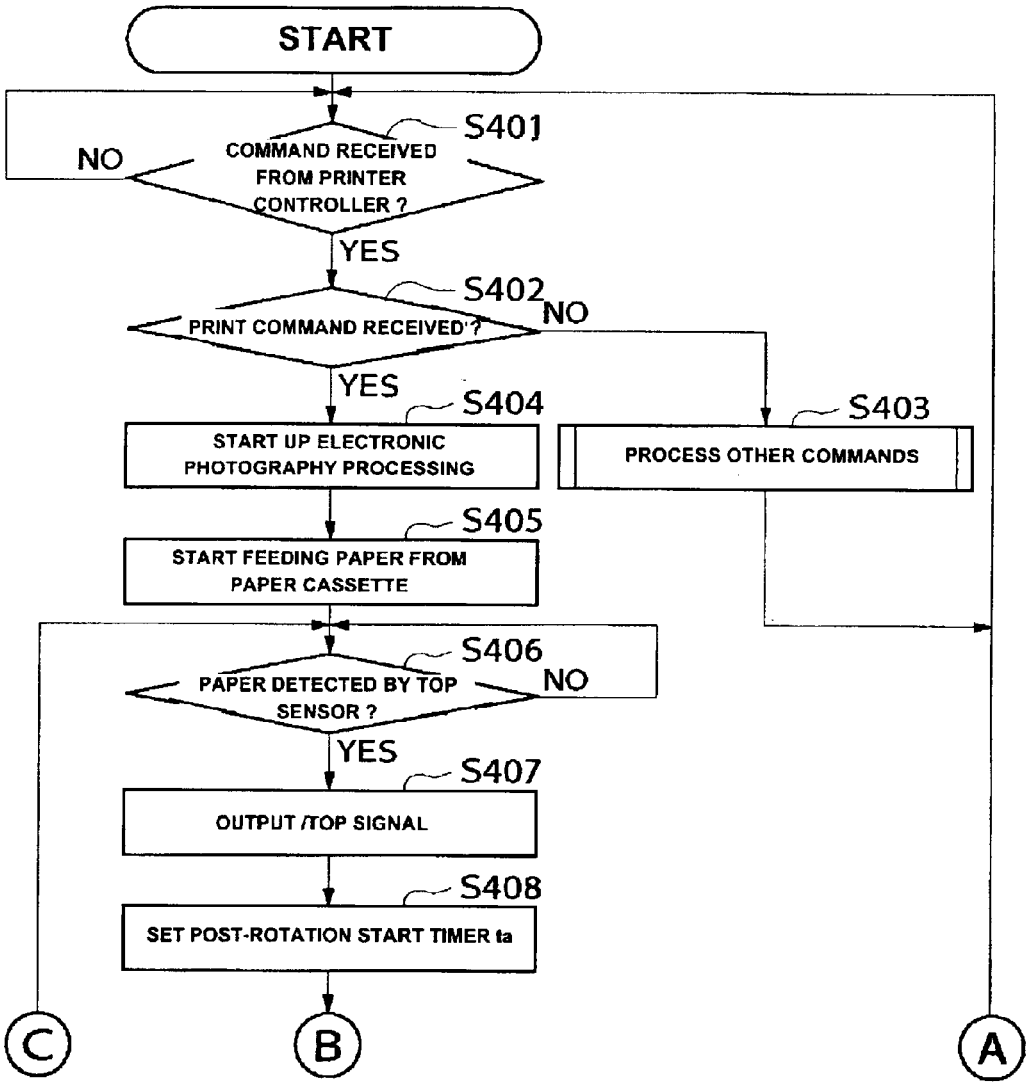
FIG. 4 shows a flow chart of a printer engine's paper delivery control performed by an engine control section 302.
Figure 5:
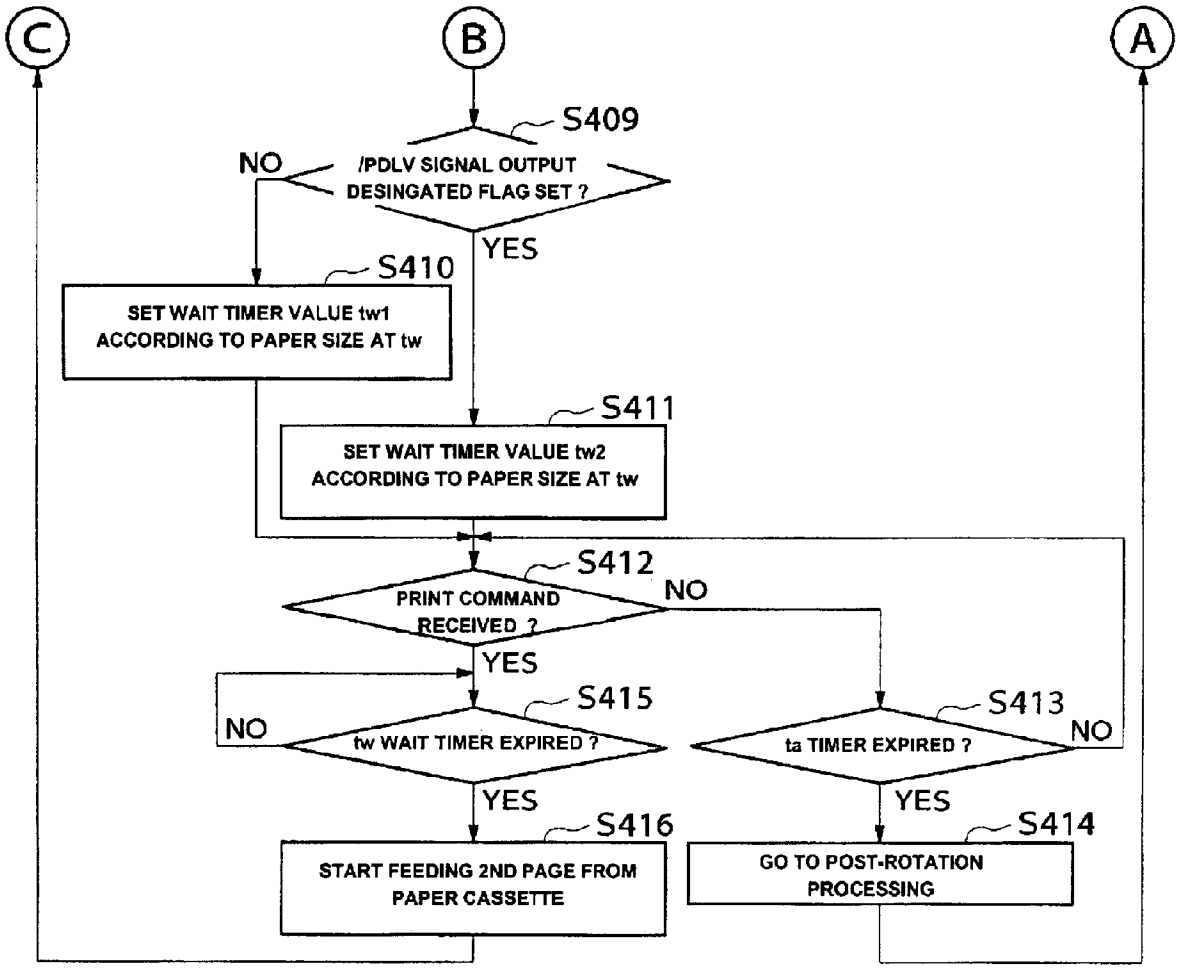
FIG. 5 shows a flow chart of a printer engine's paper delivery control performed by the engine control section 302.

Next, referring to flow charts in FIGS. 4 and 5, a description is made as to the control to switch the paper interval within the printer depending on whether or not the printer is connected to an optional paper delivery apparatus.

FIGS. 4 and 5 show flow charts of a paper transfer control over the printer engine, which is performed by the engine control section 302.

In step S401, the print timing control section 320 of the engine control section 302 judges as to whether or not the engine control section 302 has received a command from the printer controller 301 through the command/status signal line (/SC), and the print timing control section 320 proceeds to step S402 when the command is received through the command/status signal line (/SC).

In step S402, the print timing control section 320 of the engine control section 302 judges as to whether or not the command received from the printer controller 301 is a print command that is an instruction to start a printing operation. When the command received by the engine control section 302 from the printer controller 301 is a print command, the print timing control section 320 proceeds to step S404. When the command is a command other than the print command, a processing according to the received command is executed.

In step S404, the engine control section 302 starts a start-up processing for electronic photography processing (i.e., pre-rotation processing).

Then, in step S405, the engine control section 302, upon completion of predetermined steps in the pre-rotation processing, starts feeding a paper sheet from a paper feeding point designated by the print command (i.e., the manual feeding tray 210 or the standard paper cassette 208). When the standard paper cassette 208 is designated, the paper feeding solenoid SL is turned ON to start feeding a paper sheet by rotating the standard paper cassette feeding roller 209.

In step S406, the engine control section 302 judges as to whether a leading edge of a paper sheet has reached the position of a TOP sensor (i.e., the register sensor 213). When it is determined that the leading edge of the paper sheet is detected by the TOP sensor 213, a /TOP signal is transmitted from the video interface control section 316 to the printer controller 301, in step S407. Although omitted from the flow chart in FIG. 4, the printer controller 301 transmits, upon receiving the /TOP signal, image data to be printed to the video interface control section 316. Then, the engine control section 302 starts an image forming operation including the steps of transferring toner images according to the image data onto the paper sheet that has been fed in step S405 to form images on the paper sheet, and fixing the images on the paper sheet by the fixer 207.

In step S408, when the engine control section 302 does not receive a new print command in a predetermined time period after it has received the print command, the engine control section 302 sets a post-rotation start timer ta that indicates a timing to start a post-rotation processing (i.e., an ending processing for electronic photography processing).

In step S409, the engine control section 302 judges as to whether or not a /PDLV signal output designation flag is set; in other words, it judges as to whether or not the paper delivery stacker 217 is connected to the printer. When the /PDLV signal output designation flag is not set, the engine control section 302 proceeds to step S410. When the /PDLV signal output designation flag is set, the engine control section 302 proceeds to step S411.

It one example, a predetermined value for the /PDLV signal output designation flag may be stored in a memory (not shown) in the print timing control section 320; and the value stored in the memory may be made different between the case where the /PDLV signal output designation flag is set and the case where the /PDLV signal output designation flag is not set. By storing such a value, the print timing control section 320 can judges as to whether or not the /PDLV signal output designation flag is set.

Upon analyzing a signal that designates a paper delivery destination of each paper sheet for each of the plurality of pages of the image signal to be printed, if it is determined as a result of the analysis that the paper delivery tray 218 of the paper delivery stacker 217 is designated as a paper delivery destination, the printer controller 301 transmits to the engine control section 302 a command instructing that a paper delivery signal (/PDLV signal) be transmitted.

In other words, based on the signal that is inputted from an external apparatus indicating paper delivery destinations for a plurality of paper sheets for printing the image data, the printer controller 301 decides for each of the plurality of pages of the image signal as to whether or not a command instructing that a paper delivery signal (/PDLV signal) be transmitted be sent to the engine control section 302.

As a result of the decision, the printer controller 301 may transmit to the engine control section 302 an instruction for specified pages among the plurality of pages that a paper delivery signal (/PDLV signal) be transmitted. In this case, prior to transmitting to the engine control section 302 a print command for the specified pages, the printer controller 301 transmits to the engine control section 302 the instruction for the specified pages that a paper delivery signal (/PDLV signal) be transmitted.

Upon receiving the instruction as to whether or not a paper delivery signal (/PDLV signal) be transmitted, the engine control section 302 stores in its memory (not shown) /PDLV signal output designation flags. As a result, when a print command for the specified pages is executed, paper intervals between the specified pages and their preceding pages can be appropriately controlled.

In step S410, the engine control section 302 sets a paper feed wait timer value tw1 according to the paper size as a paper feed wait timer value tw such that a plurality of paper sheets are successively transferred with a paper interval that is to be applied when the paper delivery stacker 217 is not connected to the printer.

Or, in step S411, the engine control section 302 sets a paper feed wait timer value tw2 according to the paper size as the paper feed wait timer value tw such that a plurality of paper sheets are successively transferred with a paper interval that is to be applied when the paper delivery stacker 217 is connected to the printer.

The paper feed wait timer value tw can mean a value for setting a paper interval (a distance between a trailing edge of a preceding paper sheet and a leading edge of a succeeding paper to be successively transferred) when images are successively formed on a plurality of paper sheets, and can mean a timer value for determining a paper feed timing to feed a paper sheet for a succeeding page that is to be successively transferred after a leading edge of a paper sheet for a preceding page is detected by the TOP sensor 213, which is set in accordance with the following formula:

Tw=[{(paper size in a paper transfer direction)+(paper interval)}/paper transfer speed]−(traveling time for paper from a start of paper feeding until a leading edge of paper reaches the TOP sensor).

Accordingly, the value tw differs depending on the "paper size in a paper transfer direction."

In one aspect, the paper delivery stacker 217 is equipped with an Is adjusting plate (not shown) that adjusts the position of each of paper sheets as delivered in the paper width direction (in a direction perpendicular to the paper transfer direction). It takes a predetermined shifting time for shifting the adjusting plate. In order to successively form images on a plurality of paper sheets and to deliver the paper sheets, the time required for transferring each paper sheet by the paper delivery stacker 217 for a distance equivalent to the paper interval needs to be longer than the predetermined shifting time. In other words, if the time required for transferring each paper by the paper delivery stacker 217 for a distance equivalent to the paper interval were shorter than the predetermined shifting time, a paper sheet for the succeeding page is delivered while a paper sheet for the preceding page is being adjusted by the adjusting plate, such that the leading edge of the paper sheet for the succeeding page may run into the adjusting plate, which may cause paper jamming. Accordingly, the paper interval needs to be set to meet the following formula:

Paper interval/Paper transfer speed>Predetermined shifting time

When the predetermined shifting time differs for each of different paper sizes, the paper interval also needs to be set for each of the different paper sizes. In contrast, if the predetermined shifting time is the same for all different paper sizes, the same paper interval may be set without regard to the differences in paper sizes. These characteristics may depend on the structure of each paper delivery stacker.

The set paper feed wait timer values tw1 and tw2 have a relation of tw1<tw2. This relation indicates that the paper interval to be applicable when the paper delivery stacker 217 is connected to the printer is set longer than the paper interval to be applicable when the paper delivery stacker 217 is not connected to the printer.

Each of the paper feed wait timer values tw1 and tw2 is set based on the time that is calculated from the paper size, the paper interval and the paper transfer speed in the same manner as the timer value tw described above. Depending of the structure of the paper delivery stacker 217, the paper interval may be set differently for each of different paper sizes, or a constant paper interval may be set without regard to the differences in paper sizes. In either of the cases, while the relation of tw1<tw2 is maintained, the paper interval is set based on the presence or absence of the command instructing that a paper delivery signal (/PDLV signal) be outputted. As a result, even when there are restrictions in the paper delivery stacker 217 when handling the paper interval, such restrictions can be coped with.

In the description above, the predetermined shifting time in the adjustment operation in the paper width direction is described as a restrictive condition for the paper interval. However, the paper interval may be restricted by other conditions.

For example, the paper delivery destination selected by the paper delivery flapper 222 may restrict the paper interval. In this case, the paper feed wait timer value tw1, which is applicable when the paper delivery stacker 217 is not connected to the printer, may be set to a value that realizes a paper interval that provides the maximum throughput of the printer engine, and the paper feed wait timer value tw2, which is applicable when the paper delivery stacker 217 is connected to the printer, may be set to a value that realizes a minimum paper interval required for switching control by the paper delivery flapper 222. As a result, the restriction on the paper interval can be coped with.

After the paper feed wait timer value tw is set in step S410 or S411, the engine control section 302 proceeds to step S412.

In step S412, the engine control section 302 judges as to whether or not a print command for a page to be printed on a paper sheet succeeding the paper sheet that is fed in step S405 has been received. The engine control section 302 proceeds to step S415 when a printer command for the succeeding page has been received, or to step S413 when a printer command for the succeeding page has not been received.

In step S413, the engine control section 302 judges as to whether or not the post-rotation start timer ta has expired.

When the post-rotation start timer ta has not expired, the engine control section 302 judges again in step S412 as to whether or not a print command for the succeeding page has been received.

In the meantime, when the post-rotation start timer ta has expired, the engine control section 302 proceeds to step S413. In other words, when a print command for the succeeding page has not been received before the post-rotation start timer ta expires, it assumes that a series of printing instructions has been completed, and the post-rotation processing is executed in step S414, and the engine control section 302 returns to step S401.

In step S415, the engine control section 302 judges as to whether or not the paper feed wait timer tw has expired. When the paper feed wait timer tw has expired, the engine control section 302 proceeds to step S416 where paper feeding of a paper sheet for the next page from the standard paper cassette 208 is started, and then the engine control section 302 returns to step S406.

As described above, when the engine control section 302 does not receive from the printer controller 301 a command instructing that a paper delivery signal (/PDLV signal) be transmitted, the engine control section 302 judges that the paper delivery stacker 217 is not connected to the printer; and when the engine control section 302 receives from the printer controller 301 a command instructing that a paper delivery signal (/PDLV signal) be transmitted, the engine control section 302 judges that the paper delivery stacker 217 is connected to the printer.

Also, when the engine control section 302 judges that a flag designating that a paper delivery signal (/PDLV signal) be outputted is not set, the engine control section 302 sets tw1 as the paper feed wait timer tw to transfer paper sheets at the first paper interval; and when the engine control section 302 judges that a flag designating that a paper delivery signal (/PDLV signal) be outputted is set, the engine control section 302 sets tw2 as the paper feed wait timer tw that is longer than tw1 to transfer paper sheets at the second paper interval that is longer than the first paper interval.

In view of the above, the time required for transferring each paper for a distance equivalent to the first paper interval is shorter than the post-processing time required for operations such as the paper adjusting operation described above, and the time required for transferring each paper for a distance equivalent to the second paper interval is longer than the post-processing time.

Figure 6:
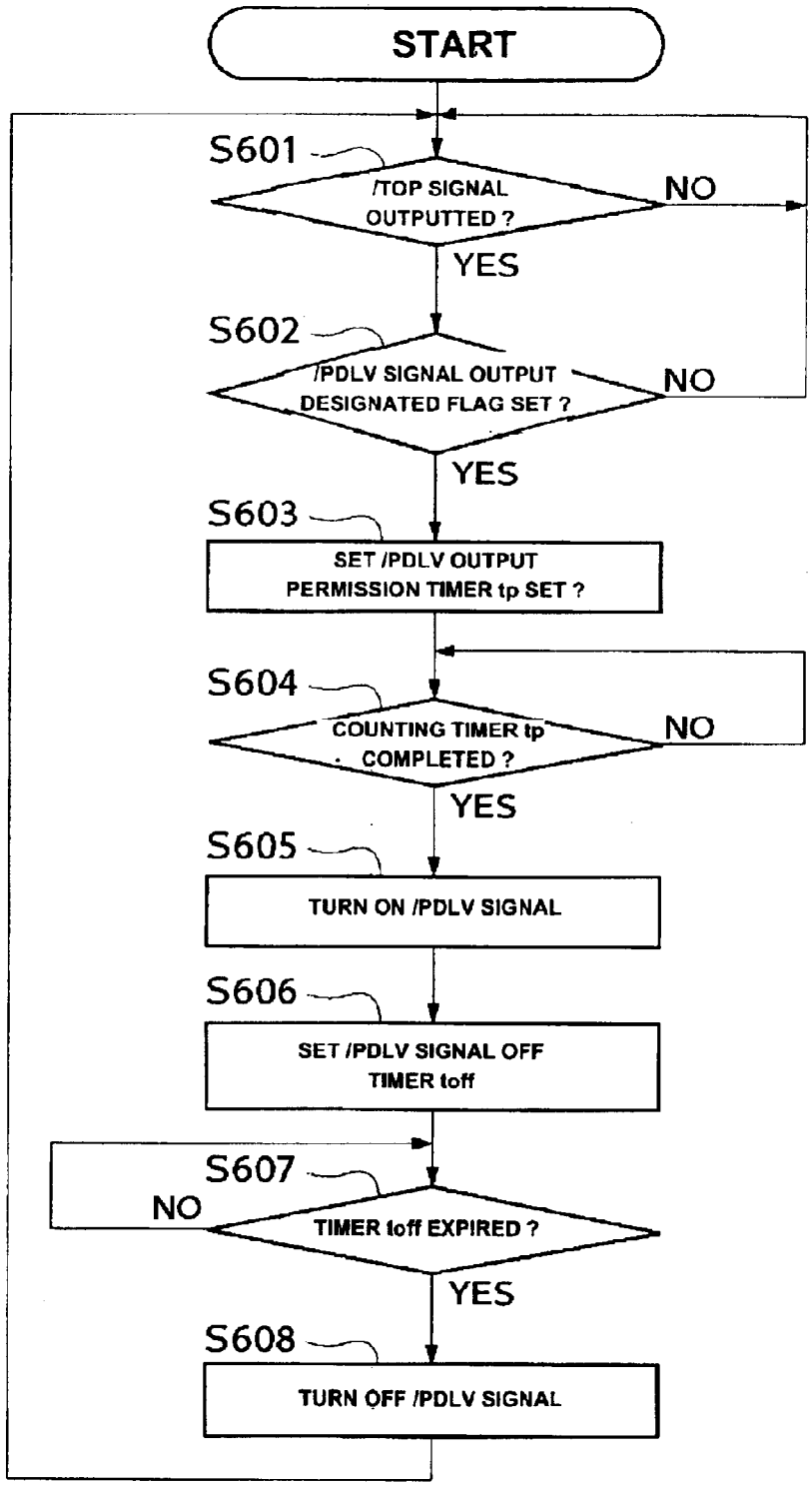
FIG. 6 shows a flow chart of an output control of paper delivery signal (PDLV signal) to a printer controller, performed by the engine control section 302.

Next, referring to a flow chart shown in FIG. 6, the ON/OFF control for paper delivery signals (/PDLV signals), which is performed by the engine control section 302, will be described. FIG. 6 shows a flow chart of the control performed by the engine control section 302 for outputting paper delivery signals (/PDLV signals) to the printer controller 301, and particularly shows a flow chart of operations for a specified single page relating to a print command.

In step S601, the video interface control section 316 of the engine control section 302 transmits a /TOP signal to the printer controller 301 in response to a detection of a paper sheet by the TOP sensor 213.

In step S602, the video interface control section 316 of the engine control section 302 judges, in response to an instruction from the printer controller 301, as to whether or not a flag designating that a paper delivery signal (/PDLV signal) be outputted is set. When a flag designating that a paper delivery signal (/PDLV signal) be outputted is not set, the engine control section 302 returns to step S601. On the other hand, when a flag designating that a paper delivery signal (/PDLV signal) be outputted is set, the engine control section 302 proceeds to step S603.

In step S603, the engine control section 302 sets a paper delivery signal (/PDLV signal) output permission timer tp.

In step S604, the engine control section 302 judges as to whether or not the paper delivery signal (/PDLV signal) output permission timer tp has expired. When the timer tp expired, the engine control section 302 proceeds to step S605.

In step S605, the engine control section 302 turns ON the paper delivery signal (/PDLV signal), to thereby transmit the paper delivery signal (/PDLV signal) to the printer controller 301 through the /PDLV signal line 321.

In step S606, the engine control section 302 sets a paper delivery signal (/PDLV signal) OFF timer toff.

In step S607, the engine control section 302 judges as to whether or not the paper delivery signal (/PDLV signal) OFF timer toff has expired, and proceeds to step S608 when the timer toff has expired.

In step S608, the engine control section 302 turns OFF the paper delivery signal ((/PDLV signal), and returns to step S601.

Next, an example of a flow of operations performed by the printer and the paper delivery stacker 217 will be described with reference to a timing chart shown in FIG. 7.

Figure 7:
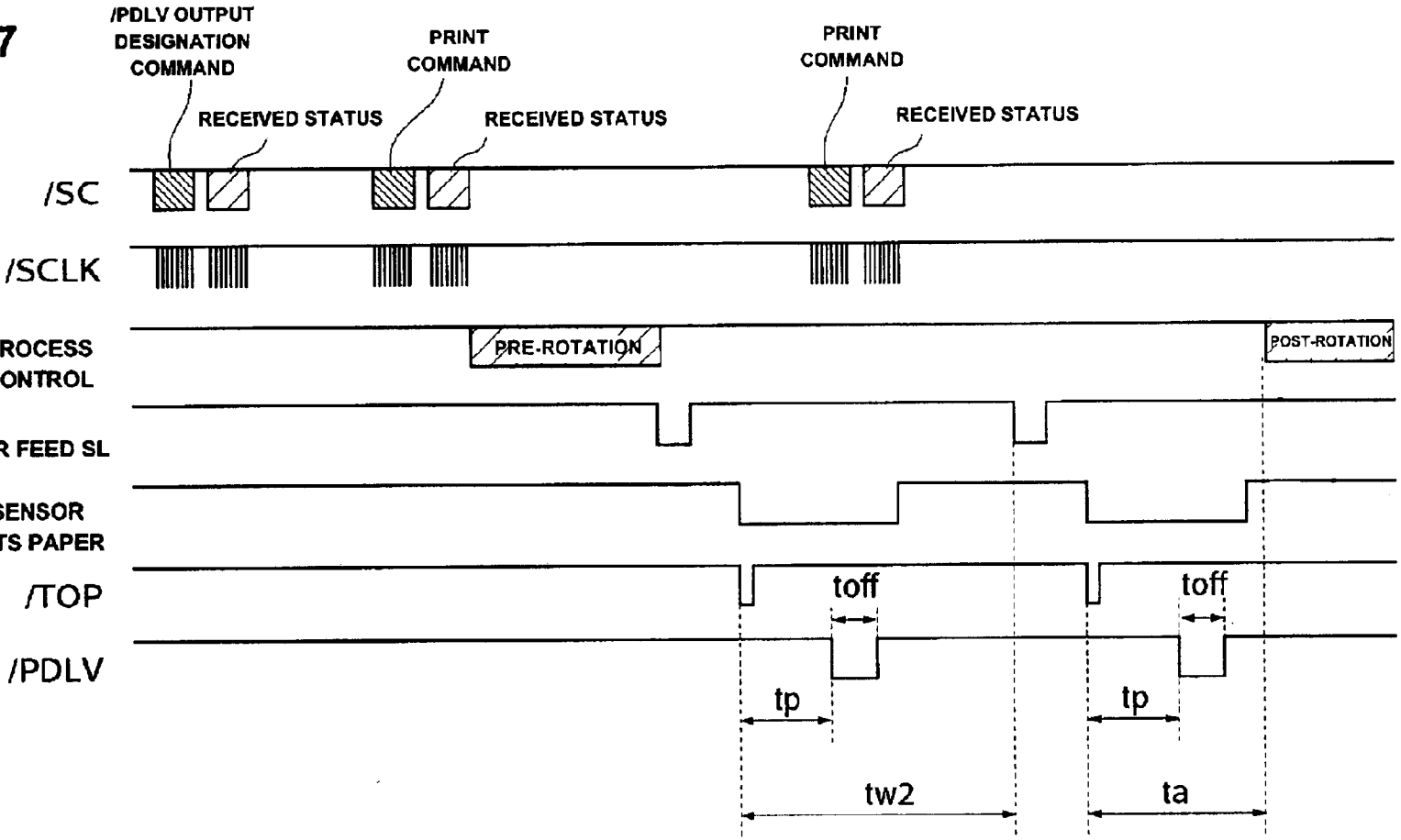
FIG. 7 shows a timing chart of various signals when a 2-page successive printing is conducted, when an output of a paper delivery signal (/PDLV signal) is designated.

FIG. 7 shows a timing chart indicating signals transmitted when two pages are successively printed, when an output of a paper delivery signal (/PDLV signal) is designated.

A paper feed wait timer value tw2 indicated in FIG. 7 is set as a paper feed wait timer value tw when the paper delivery stacker 217 is connected to the printer, which is a value that realizes a paper interval that sufficiently secures the required minimum switching time for switching control by the paper delivery flapper 222.

Also, as described above with reference to FIGS. 4 and 5, a paper feed wait timer value tw1, which is set when the paper delivery stacker 217 is not connected to the printer, is a value that realizes a paper interval with which the printer engine can achieve the maximum throughput (i.e., the shortest paper interval).

Accordingly, when the paper delivery stacker 217 is not connected to the printer, a plurality of paper sheets can be transferred with the shortest paper interval that can be achieved by the printer, without having to consider the post-processing time that is required for post processings for paper sheets at the paper delivery stacker 217.

Second Embodiment

Figure 8:
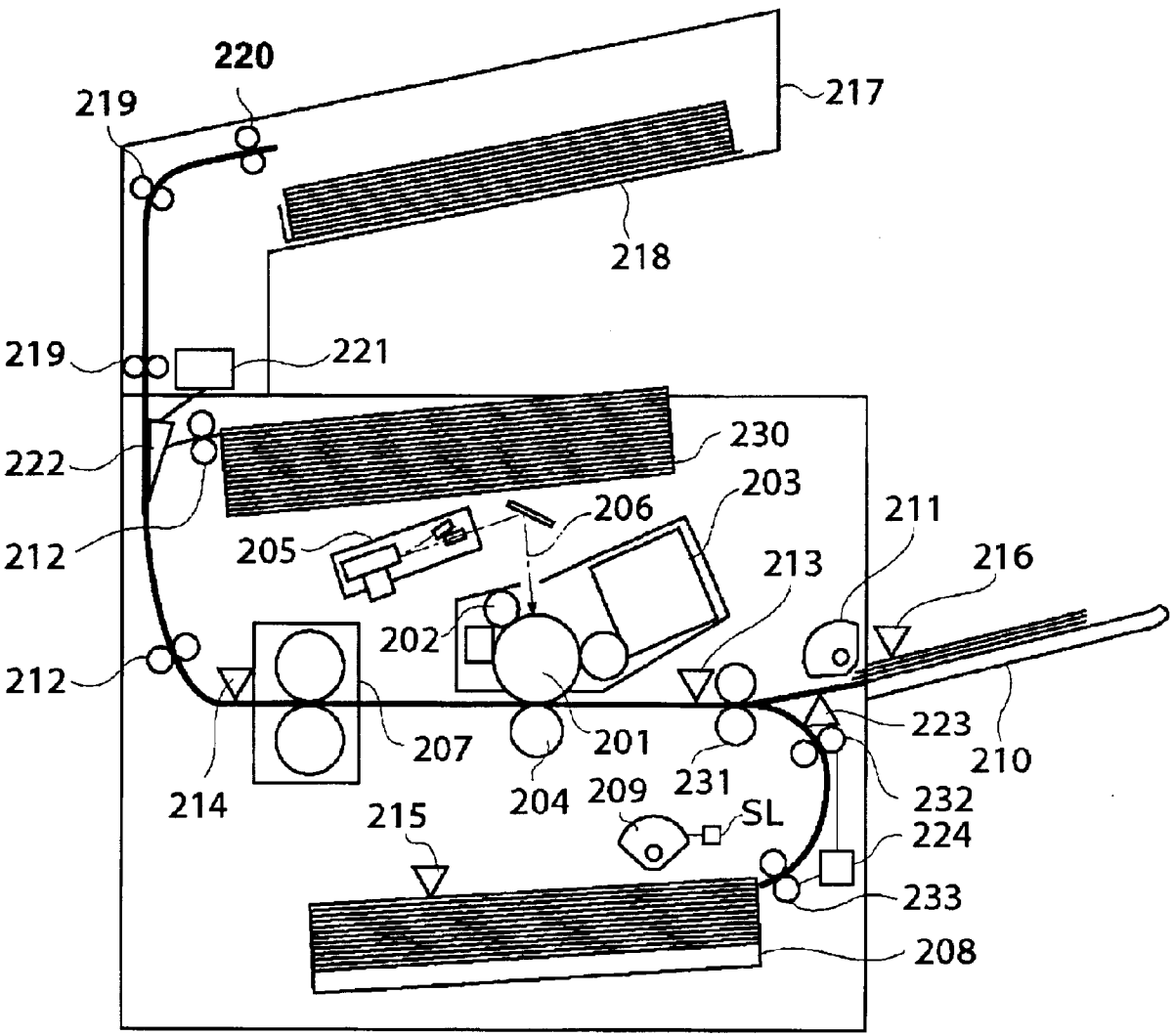
FIG. 8 shows a cross-sectional view of a structure of an electronic photography type printer.

FIG. 8 shows a cross-sectional view of a structure of an electronic photography type printer in accordance with a second embodiment of the present invention.

The electronic photography type printer in accordance with the second embodiment may be formed from components that are substantially the same as those of the first embodiment described above with reference to FIG. 1. Accordingly, only features of the second embodiment that are different from the first embodiment will be briefly described below. Also, the composition of a control system in the second embodiment may be the same as that of the first embodiment as shown in FIG. 2, illustration and description of the control system are omitted.

In accordance with the second embodiment, an intermediate sensor 223 is provided on the downstream side of the transfer roller 232 (i.e., on the upstream side of the register roller 231). The intermediate sensor 233 measures intervals of detections of paper sheets that are successively fed and transferred from the standard paper cassette 208, in other words, measures inter-paper distances between the paper sheets.

Also, in accordance with the second embodiment, the printer is equipped with an intermediate clutch 224 that controls the transfer rollers (transfer roller pairs) 232 and 233 such that the transfer rollers 232 and 233 can transfer paper or cannot transfer paper. The intermediate clutch 224 is used to adjust the inter-paper distance by using an inter-paper distance measured by the intermediate sensor 233.

In other words, in accordance with the second embodiment, the paper feed timing is not controlled to appropriately change the paper interval, like the first embodiment, depending on whether or not the printer is connected to the paper delivery stacker 217.

In accordance with the second embodiment, the paper feed timing is always set to a timing that achieves the maximum throughput that can be attained by the printer engine without regard to whether or not the printer is connected to the paper delivery stacker 217. When the paper interval needs to be adjusted according to a post-processing time that is required by the paper delivery stacker 217, the transfer operation for paper on the upstream side is stopped by the intermediate clutch 224.

In other words, even in a case where there is not a big difference between the shortest paper interval that is required for the paper delivery stacker 217 to normally function and the paper interval that is set when the printer is not connected to the paper delivery stacker 217, the paper interval may be adjusted such that paper sheets can be securely delivered to the paper delivery stacker 217 without treating such a case as jamming.

The "case where there is not a big difference" as described above may indicate a case when the paper interval suddenly becomes short, for example, when a linked pickup of paper sheets from the standard paper cassette 208 occurs.

In other words, even when a paper interval is set for the condition where the printer is not connected to the paper delivery stacker 217 and a plurality of paper sheets are to be successively printed, there would be no problem if the paper delivery stacker 217 may be connected to the printer unless there is a linked pickup of paper sheets at the paper feed section.

However, when a linked pickup of paper sheets occurs at the paper feed section, a current paper interval becomes shorter than the normal paper interval. In such a case, a permissible paper interval may be different depending on whether or not the paper delivery stacker 217 is connected to the printer.

In this case, the shortened paper interval due to the linked pickup may be detected by a sensor, and threshold values for determining as to whether or not a separation function to separate paper sheets is activated may be switched depending on the presence or absence of the paper delivery stacker 217. In this case, a threshold value that is applicable when a paper delivery optional apparatus is not present is shorter than a threshold value that is applicable when a paper delivery optional apparatus is present.

Figure 9:
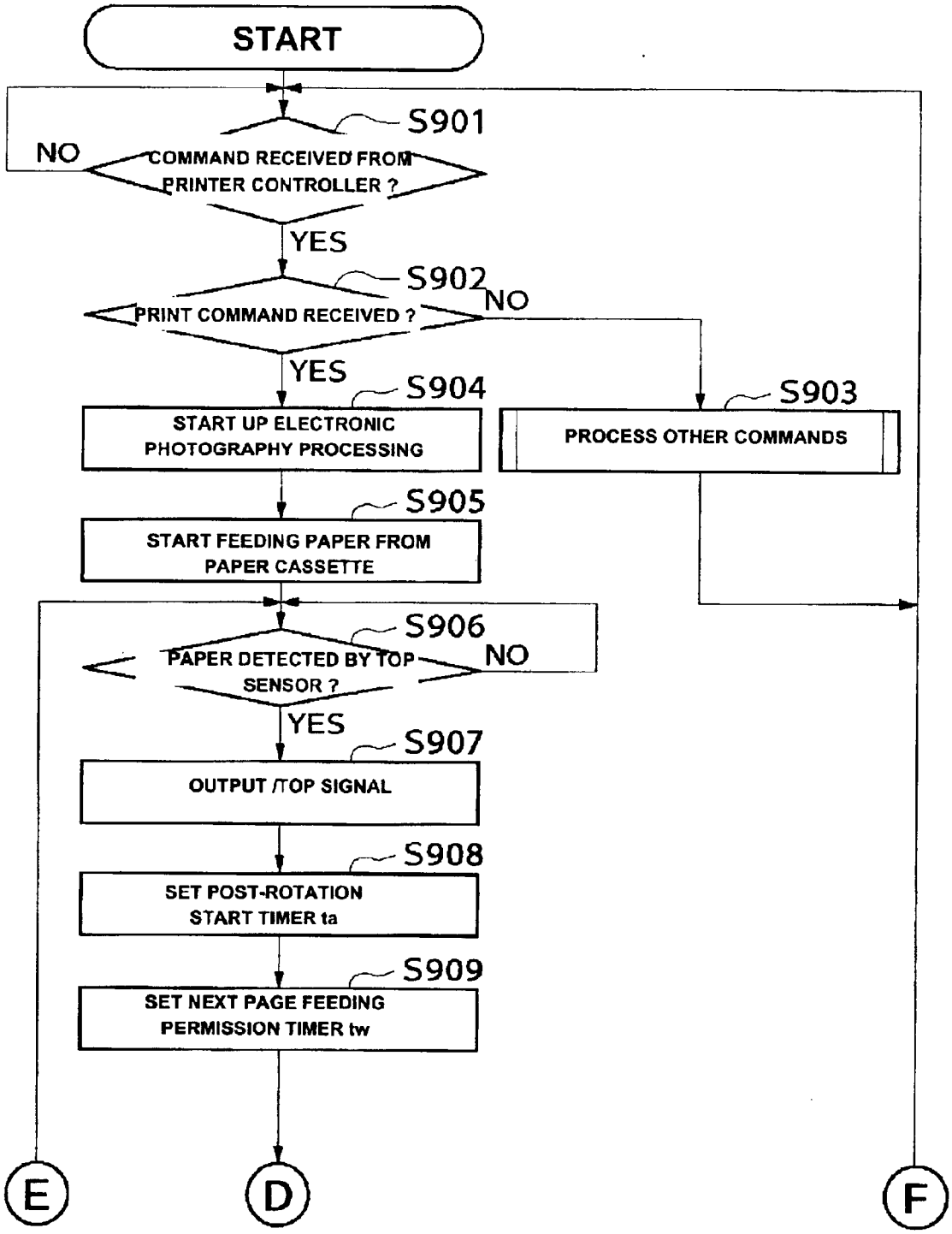
FIG. 9 shows a flow chart of a process to adjust paper interval.
Figure 10:
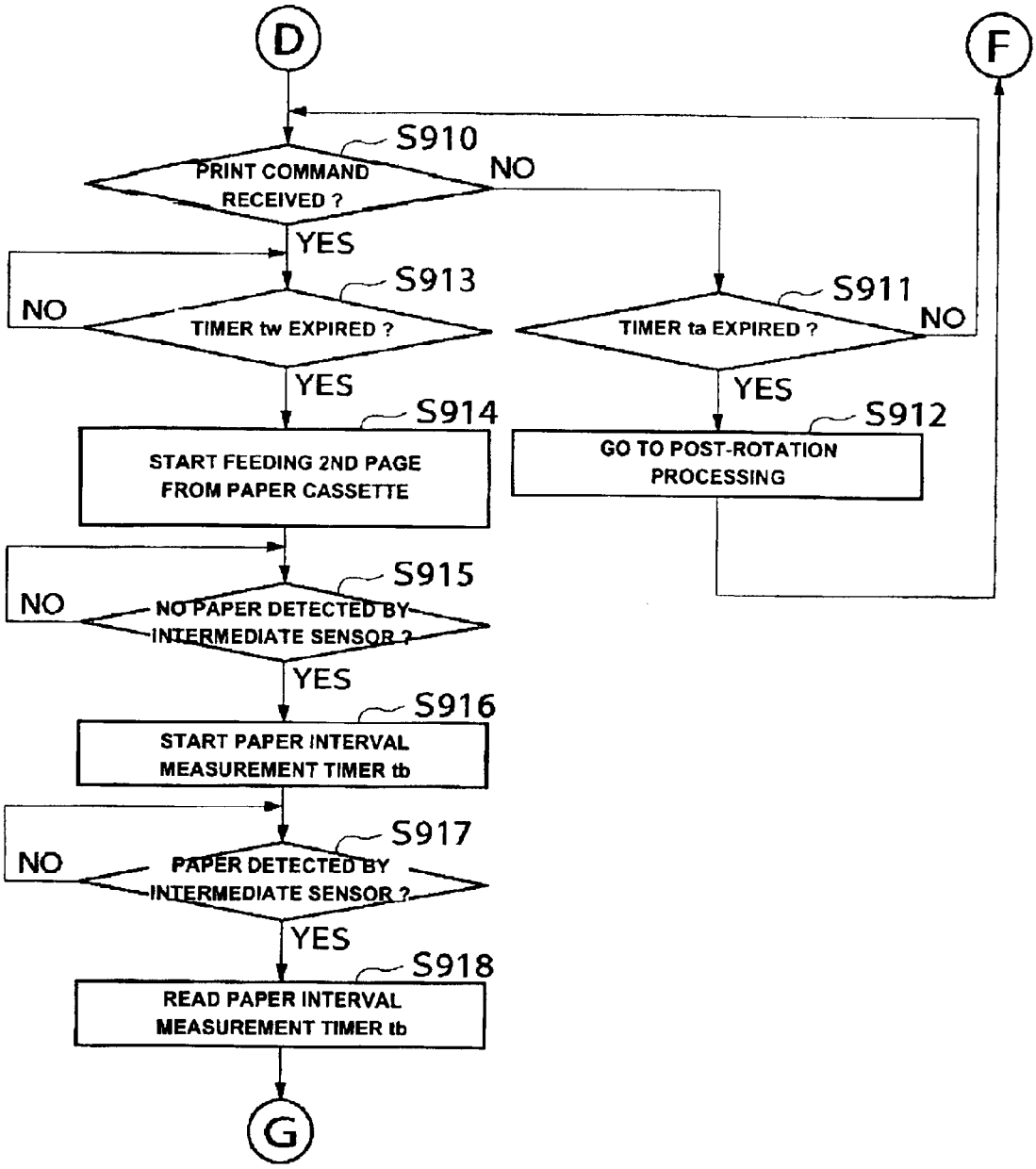
FIG. 10 shows a flow chart of a process to adjust paper interval.
Figure 11:
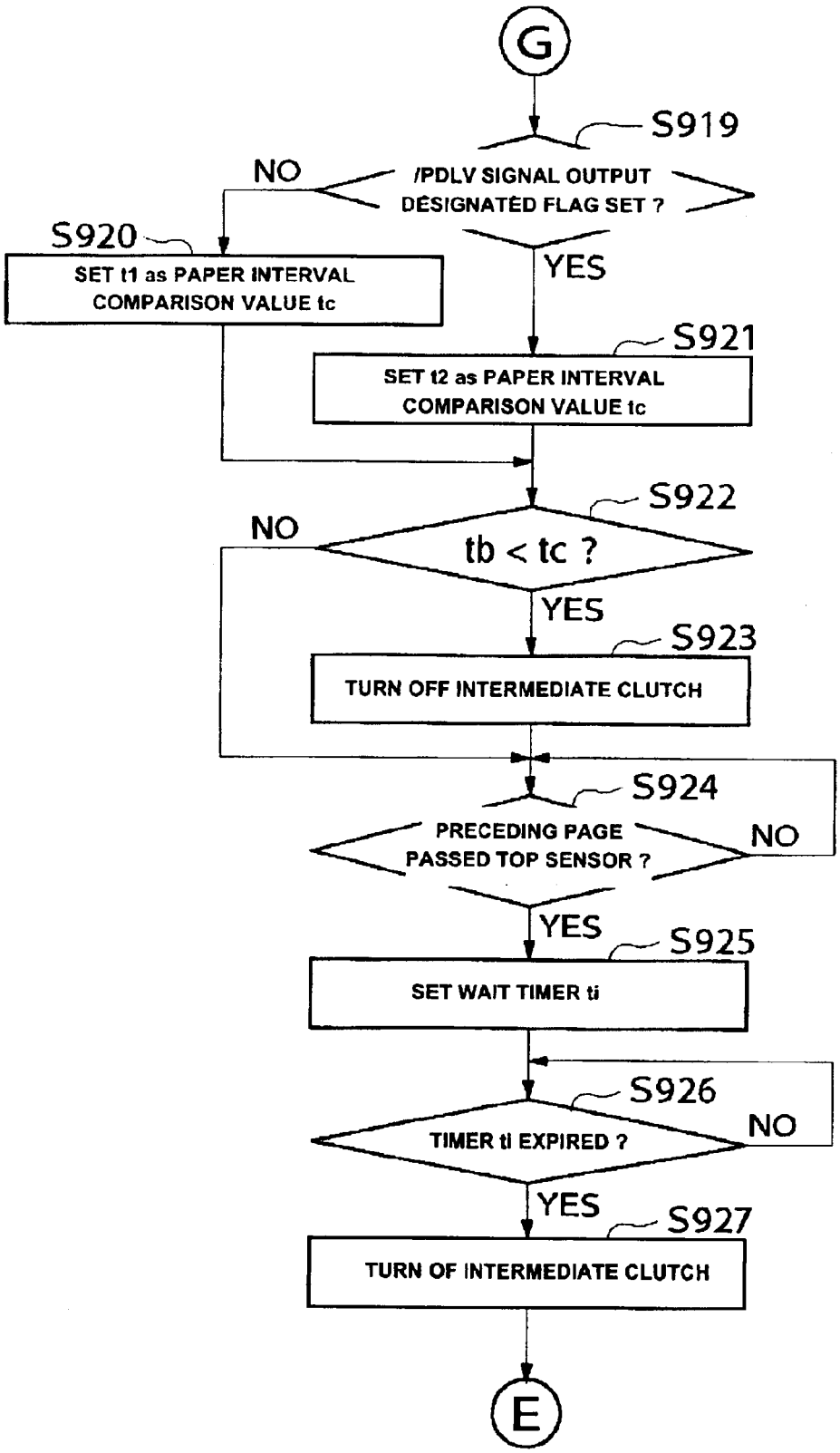
FIG. 11 shows a flow chart of a process to adjust paper interval.
Figure 12:
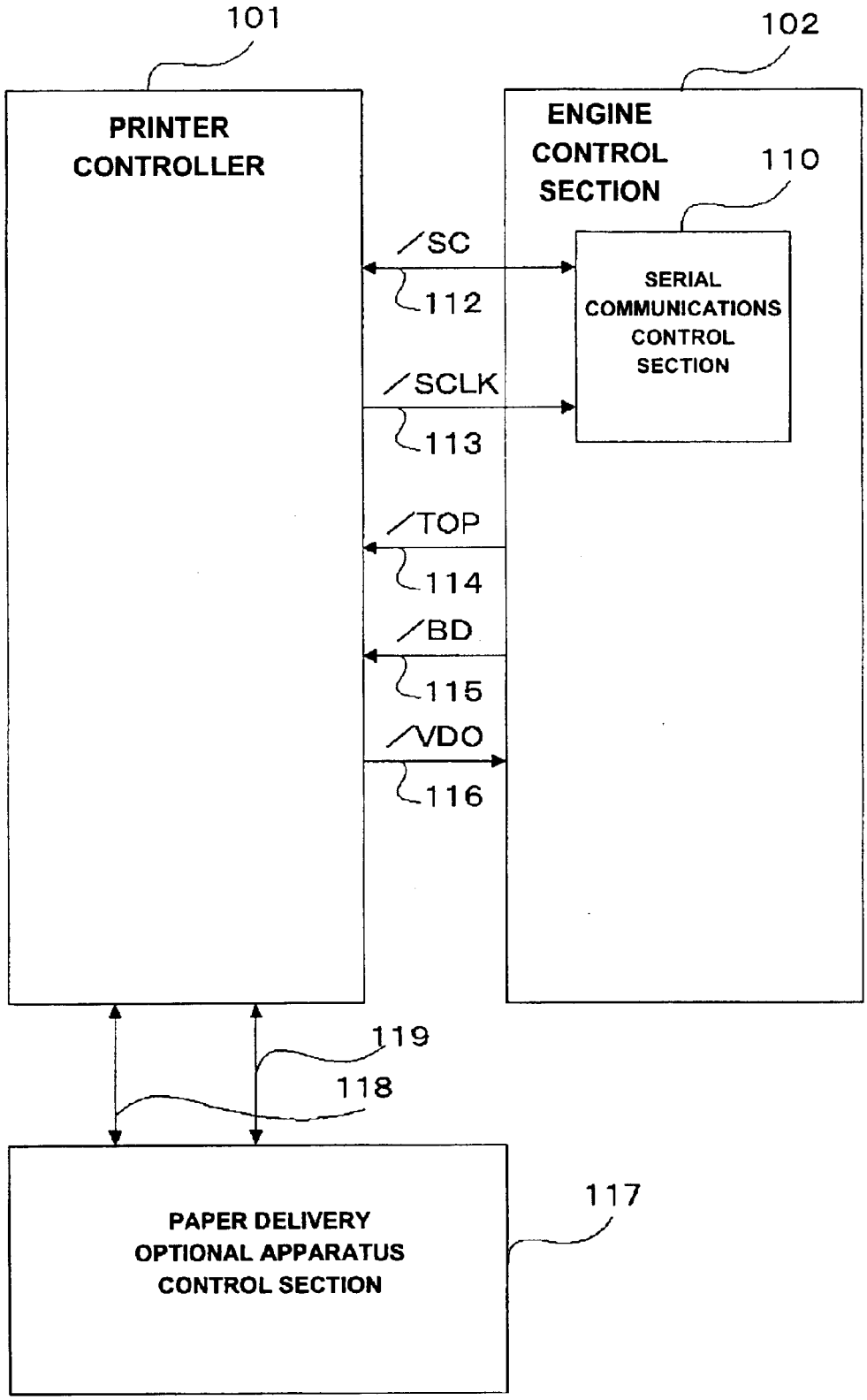
FIG. 12 (Prior Art)
FIG. 12 shows a block diagram of a control structure of a conventional image forming apparatus.

Next, referring to flow charts in FIGS. 9–11, a paper interval adjustment processing in accordance with the second embodiment will be described.

In step S901, the print timing control section 320 of the engine control section 302 judges as to whether or not the engine control section 302 has received a command from the printer controller 301, and proceeds to step S902 when it is judged that the command has been received.

In step S902, the print timing control section 320 of the engine control section 302 judges as to whether or not the command received from the printer controller 301 in step S901 is a print command. When the command received is not a print command (for example, a command to designate a paper feed point), the print timing control section 320 proceeds to step S903, and executes a command processing according to the received command. On the other hand, when the received command is a print command, the print timing control section 320 proceeds to step S903, and starts a start-up processing for electronic photography processing (i.e., a pre-rotation processing).

Then, in step S905, the engine control section 302 starts feeding a paper sheet from a paper feeding point (the manual paper feeding tray 210 or the standard paper cassette 208) designated by the print command when predetermined processings of the pre-rotation processing are completed. When the standard paper cassette 208 is designated, the paper feeding solenoid SL is turned ON to start feeding a paper sheet by rotating the standard paper cassette feeding roller 209.

In step S906, the engine control section 302 judges as to whether a leading edge of a paper sheet has reached the position of a TOP sensor (i.e., the register sensor 213). When it is determined that the leading edge of the paper sheet is detected by the TOP sensor 213, a /TOP signal is transmitted from the video interface control section 316 to the printer controller 301, in step S907. Although omitted from the flow chart in FIG. 9, the printer controller 301 transmits, upon receiving the /TOP signal, image data to be printed to the video interface control section 316. Then, the engine control section 302 starts an image forming operation including the steps of transferring toner images according to the image data onto the paper sheet that has been fed in step S905 to form images on the paper sheet, and fixing the images on the paper sheet by the fixer 207.

In step S908, when the engine control section 302 does not receive a new print command in a predetermined time period after it has received the print command, the engine control section 302 sets a post-rotation start timer ta that indicates a timing to start a post-rotation processing (i.e., an ending processing for electronic photography processing).

In step S909, the engine control section 302 sets a next page feeding permission timer (a paper feed wait timer) tw.

In step S910, the engine control section 302 judges as to whether or not a print command for the next page has been received. When a print command for the next page has not been received, the engine control section 302 proceeds to step S911, and judges as to whether or not the post-rotation start timer ta has expired.

As a result, when it is determined that the post-rotation start timer ta has expired, in other words, when a print command for the next page has not been received before the post-rotation start timer ta expires, the engine control section 302 assumes in step S912 that a series of printing instructions has been completed, executes the port-rotation processing, and returns to step S910.

On the other hand, when it is determined that the post-rotation start timer ta has not expired, the engine control section 302 returns to step S901, and waits for a print command for the next page.

In step S913, the engine control section 302 judges, in response to a reception of a print command for the next page, as to whether or not the next page feeding permission timer tw has expired.

In step S914, the engine control section 302 feeds the next paper sheet from the standard paper cassette 208.

In step S915, the engine control section 302 judges as to whether or not the intermediate sensor 223 detects the leading edge of the preceding paper sheet, and in step S916, the engine control section 302 starts a paper interval measurement timer tb when the leading edge of the preceding paper sheet is detected.

In step S918, the engine control section 302 reads the paper interval measurement timer tb.

In step S919, the engine control section 302 judges as to whether or not a /PDLV signal output designation flag is set; in other words, it judges as to whether or not the paper delivery stacker 217 is connected to the printer. When the /PDLV signal output designation flag is not set, the engine control section 302 proceeds to step S920. When the /PDLV signal output designation flag is set, the engine control section 302 proceeds to step S921.

In step S920, the engine control section 302 sets a threshold value t1 as a paper interval comparison value tc, when the paper delivery stacker 217 is not connected to the printer.

Or, in step S921, the engine control section 302 sets a threshold value t2 as the paper interval comparison value tc, as the paper delivery signal (/PDLV signal) output designation flag is set, and the paper delivery stacker 217 is connected to the printer.

The threshold values t1 and t2 have a relation of t1<t2. When the paper delivery stacker 217 is connected to the printer, a longer paper interval (a greater threshold value) is determined to be required than a paper interval to be applicable when the paper delivery stacker 217 is not connected to the printer.

In step S922, the engine control section 302 compares the value of the paper interval measurement timer tb with the value of the paper interval comparison value tc. The engine control section 302 proceeds to step S923 when the value of the paper interval measurement timer tb is smaller than the value of the paper interval comparison value tc, and turns OFF the intermediate clutch 244 to stop transfer of a paper sheet on the upstream side.

On the other hand, as a result of the comparison between the value of the paper interval measurement timer tb and the value of the paper interval comparison value tc, if the value of the paper interval measurement timer tb is greater than the value of the paper interval comparison value tc, the engine control section 302 proceeds to step S924, and waits for the paper sheet for the preceding page to completely pass the TOP sensor 213.

When the paper sheet for the preceding page completely passes the TOP sensor 213, the engine control section 302 turns ON the intermediate clutch 244 after a predetermined time passes (steps S925, S926 and S927), and returns to step S906. More specifically, when the paper sheet for the preceding page completely passes the TOP sensor 213, the engine control section 302 sets a wait timer ti in step S924, checks if the wait timer ti expires in step S926, and turns ON the intermediate clutch 244 after a predetermined time passes.

It is noted that the present invention is not limited to the embodiments described above. For example, in the first embodiment, the paper interval may be changed by controlling the paper feed operation according to the presence or absence of a connection between the paper delivery stacker 217 and the printer, instead of changing the paper interval by controlling the paper feed timing according to the presence or absence of a connection between the paper delivery stacker 217 and the printer. In this manner, the first embodiment and the second embodiment may be combined depending on the requirements.

Also, in the first and second embodiments described above, the engine control section 302 recognizes a connection status between the paper delivery stacker 217 and the printer with a command instructing that a paper delivery signal (/PDLV signal) be outputted, which is sent from the printer controller 301. However, the printer controller 301 may send to the engine control section 302 a signal directly indicating that a paper delivery optional apparatus (e.g., the paper delivery stacker 217) is connected to the printer, such that the engine control section 302 may recognize a connection status between the per delivery optional apparatus and the printer.

Furthermore, in the embodiments described above, a paper delivery apparatus (e.g., a paper delivery stacker) is described as a paper handling apparatus that is detachably mounted on a printer. However, the paper handling apparatus may be a post-processing apparatus that may have a function other than the paper delivery stacker function, such as, a sorting function, a stapling function or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An image forming apparatus on which a paper handling apparatus is detachably mountable, the image forming apparatus comprising:

an image processing section that processes an externally inputted image signal;

an image forming section that forms an image on a paper sheet based on the image signal processed by the image processing section; and a control section that controls the image forming section based on an instruction from the image processing section, wherein the control section transmits to the image processing section a paper delivery signal indicating a timing to deliver paper sheets from the image forming section to the paper handling apparatus, wherein the image processing section controls the paper handling apparatus based on the paper delivery signal received from the control section, and the control section successively transfers a plurality of paper sheets at a first paper interval when images are successively formed on a plurality of paper sheets and the control section does not receive from the image processing section an instruction to transmit a paper delivery signal, and successively transfers a plurality of paper sheets at a second paper interval different from the first paper interval when images are successively formed on a plurality of paper sheets and the control section receives from the image processing section an instruction to transmit a paper delivery signal.

2. An image forming apparatus according to claim 1, wherein, when the control section receives from the image processing section the instruction to transmit a paper delivery signal, the control section transmits the paper delivery signal.

3. An image forming apparatus according to claim 2, wherein, when the control section does not receive from the image processing section the instruction to transmit a paper delivery signal, the control section does not transmit the paper delivery signal and, when the control section receives from the image processing section the instruction to transmit a paper delivery signal, the control section transmits the paper delivery signal.

4. An image forming apparatus according to claim 1, wherein a post-processing time for the paper handling apparatus to perform a post-processing for each of the paper sheets is longer than a time corresponding to the first paper interval, and the post-processing time is shorter than a time corresponding to the second paper interval.

5. An image forming apparatus according to claim 4, wherein the first paper interval is a minimum paper interval with which the image forming section is capable of transferring the plurality of paper sheets.

6. An image forming apparatus according to claim 4, wherein the paper handling apparatus is a paper delivery apparatus.

7. An image forming apparatus according to claim 6, wherein the paper delivery apparatus is equipped with a switching section that switches a paper delivery destination between a paper delivery section on the image forming apparatus and the paper delivery section on the paper delivery apparatus, and the post-processing time is a time that is required by the switching section to switch the paper delivery destination.

8. An image forming apparatus according to claim 6, wherein the paper delivery apparatus is equipped an adjusting section that adjusts end sections of paper sheets delivered to the paper delivery apparatus, and the post-processing time is a time that is required by the adjusting section to adjust the end sections.

9. An image forming apparatus according to claim 1, wherein the control section controls a timing of the image forming section to feed a plurality of paper sheets to change a paper interval between adjacent ones of the plurality of paper sheets to one of the first paper interval and the second paper interval.

10. An image forming apparatus according to claim 1, wherein the control section transfers the plurality of paper sheets at a constant speed.

11. An image forming apparatus according to claim 1, wherein the image processing section transmits to the control section an instruction that the paper delivery signal be transmitted, when a paper delivery destination for paper sheets for forming images thereon is the paper delivery apparatus.

12. An image forming apparatus according to claim 11, wherein the image processing section does not transmit to the control section an instruction that the paper delivery signal be transmitted, when a paper delivery destination for paper sheets for forming images thereon is not the paper delivery apparatus.

13. An image forming apparatus according to claim 1, wherein the image processing section decides based on an externally inputted signal for each of a plurality of pages for printing images of the image signal as to whether or not an instruction that the paper delivery signal be transmitted is sent to the control section.

14. An image forming apparatus on which a paper delivery apparatus is detachably mountable, the image forming apparatus comprising:

an image processing section that processes an externally inputted image signal;

an image forming section that forms an image on a paper sheet based on the image signal processed by the image processing section; and a control section that controls the image forming section based on an instruction from the image processing section, wherein the control section transmits to the image processing section a paper delivery signal indicating a timing to deliver paper sheets from the image forming section to the paper delivery apparatus, wherein the image processing section controls the paper delivery apparatus based on the paper delivery signal received from the control section, and the control section judges that the paper delivery apparatus is not connected to the image forming apparatus when the control section does not receive from the image processing section an instruction to transmit a paper delivery signal, and judges that the paper delivery apparatus is connected to the image forming apparatus when the control section receives from the image processing section an instruction to transmit a paper delivery signal.

15. An image forming apparatus according to claim 14, wherein the control section successively transfers a plurality of paper sheets at a first paper interval when images are successively formed on a plurality of paper sheets and the control section judges that the paper delivery apparatus is not connected to the image forming apparatus, and successively transfers a plurality of paper sheets at a second paper interval different from the first paper interval when images are successively formed on a plurality of paper sheets and the control section judges that the paper delivery apparatus is connected to the image forming apparatus.

16. An image forming apparatus according to claim 14, wherein the image processing section decides based on an externally inputted signal for each of a plurality of pages for printing images of the image signal as to whether or not an instruction that the paper delivery signal be transmitted is sent to the control section.

17. An image forming apparatus on which a paper delivery apparatus is detachably mountable, the image forming apparatus comprising:

an image forming section that forms an image on a paper sheet based on an image signal processed by an image processing section that processes an externally inputted image signal; and a control section that controls the image forming section based on an instruction from the image processing section, wherein the control section transmits to the image processing section a paper delivery signal indicating a timing to deliver paper from the image forming section to the paper delivery apparatus, wherein the control section successively transfers a plurality of paper sheets at a first paper interval when images are successively formed on the plurality of paper sheets and the control section does not receive from the image processing section an instruction to transmit a paper delivery signal, and successively transfers a plurality of paper sheets at a second paper interval different from the first paper interval when images are successively formed on the plurality of paper sheets and the control section receives from the image processing section an instruction to transmit a paper delivery signal.

18. An image forming method for an image forming apparatus on which a paper delivery apparatus is detachably mountable, the image forming apparatus including an image processing section that processes an externally inputted image signal and an image forming section that forms an image on a paper sheet, the method comprising:

a transmission step of transmitting from a control section that controls the image forming section to the image processing section a paper delivery signal indicating a timing to deliver paper sheets from the image forming section to the paper delivery apparatus;

a control step of controlling the paper delivery apparatus by the image processing section based on the paper delivery signal transmitted in the transmission step; and a transfer step of successively transferring a plurality of paper sheets, wherein the transfer step successively transfers a plurality of paper sheets at a first paper interval when the control section receives from the image processing section an instruction to transmit a paper delivery signal, and successively transfers a plurality of paper sheets at a second paper interval different from the first paper interval when the control section does not receive from the image processing section an instruction to transmit a paper delivery signal.

19. An image forming method according to claim 18, wherein, when the control section receives from the image processing section an instruction to transmit a paper delivery signal, the transfer step is executed.

20. An image forming method according to claim 19, wherein, when the control section does not receive from the image processing section an instruction to transmit a paper delivery signal, the transmission step is not executed.

21. An image forming method according to claim 18, wherein a post-processing time for the paper delivery apparatus to perform a post-processing for each of the paper sheets is longer than a time corresponding to the first paper interval, and the post-processing time is shorter than a time corresponding to the second paper interval.

22. An image forming method according to claim 21, wherein the first paper interval is a minimum paper interval with which the image forming section is capable of transferring the plurality of paper sheets.

23. An image forming method according to claim 21, wherein the paper delivery apparatus is equipped with a switching section that switches a paper delivery destination between a paper delivery section on the image forming apparatus and the paper delivery section on the paper delivery apparatus, and the post-processing time is a time that is required by the switching section to switch the paper delivery destination.

24. An image forming method according to claim 21, wherein the paper delivery apparatus is equipped an adjusting section that adjusts end sections of paper sheets delivered to the paper delivery apparatus, and the post-processing time is a time that is required by the adjusting section to adjust the end sections.

25. An image forming method according to claim 18, wherein the transfer step transfers the plurality of paper sheets at a constant speed.

26. An image forming method according to claim 18, further comprising a deciding step of deciding based on an externally inputted signal for each of a plurality of pages for printing images of the image signal as to whether or not an instruction that the paper delivery signal be transmitted from the image processing section to the control section is transmitted.

27. An image forming apparatus on which a paper delivery apparatus is detachably mountable, the image forming apparatus comprising:

an image processing section that processes an externally inputted image signal;

an image forming section that forms an image on a paper sheet based on the image signal processed by the image processing section;

a paper standby section that places in a standby condition paper sheets that are fed for forming images thereon by the image forming section to be delivered at a first paper interval; and a control section that controls the image forming section and the paper sheet standby section based on an instruction from the image processing section, wherein the control section transmits to the image processing section a paper delivery signal indicating a timing to deliver paper sheets from the image forming section to the paper delivery apparatus, wherein the image processing section controls the paper delivery apparatus based on the paper delivery signal received from the control section, and the control section controls the paper standby section such that a plurality of paper sheets are successively transferred at a first paper interval when images are successively formed on the plurality of paper sheets and the control section does not receive from the image processing section an instruction to transmit a paper delivery signal, and controls the paper standby section such that a plurality of paper sheets are successively transferred at a second paper interval different from the first paper interval when images are successively formed on a plurality of paper sheets and the control section receives from the image processing section an instruction to transmit a paper delivery signal.

* * * * *

UNITED STATES PATENT AND TRADEMARK OFFICE

CERTIFICATE OF CORRECTION

PATENT NO. : 6,819,907 B2
DATED : November 16, 2004
INVENTOR(S) : Yoji Serizawa

It is certified that error appears in the above-identified patent and that said Letters Patent is hereby corrected as shown below:

Drawings,
SHEET NO. 3, FIGURE 3, "DESINGATING" should read -- DESIGNATING --.
SHEET NO. 5, FIGURE 5, "DESINGATED" should read -- DESIGNATED --.

Column 1,
Line 51, "apparatus" should read -- apparatus. --.

Column 3,
Line 8, "lo" should be deleted.
Line 20, "place" should read -- places --.

Column 4,
Line 45, "lo" should be deleted.

Column 7,
Line 51, "notifies" should read -- notify --.
Line 54, "structure" should read -- structure. --.

Column 9,
Line 6, "interval)" should read -- interval") --.
Line 10, "are" should read -- can --.

Column 10,
Line 61, "judges" should read -- judge --.

Column 11,
Line 57, "Is" should be deleted.

Column 12,
Line 27, "of" should read -- on --.

Column 14,
Line 18, "(LL/PDLV" should read -- (/PDLV --.

Column 19,
Line 25, "equipped" should read -- equipped with --.

UNITED STATES PATENT AND TRADEMARK OFFICE

CERTIFICATE OF CORRECTION

PATENT NO. : 6,819,907 B2
DATED : November 16, 2004
INVENTOR(S) : Yoji Serizawa

It is certified that error appears in the above-identified patent and that said Letters Patent is hereby corrected as shown below:

Column 21,
Line 47, "equipped" should read -- equipped with --.

Signed and Sealed this

Twenty-fourth Day of May, 2005

JON W. DUDAS
*Director of the United States Patent and Trademark Office*